United States Patent [19]

Hickman

[11] Patent Number: 4,871,900

[45] Date of Patent: Oct. 3, 1989

[54] BODY AIR DRYER

[76] Inventor: O'Neal Hickman, 354 Gould Ave., North, Whistler, Ala. 36612

[21] Appl. No.: 237,283

[22] Filed: Aug. 26, 1988

[51] Int. Cl.[4] ..... F24H 9/02

[52] U.S. Cl. ..... 219/366; 219/367; 219/369; 219/373; 4/526; 4/600; 34/202; 128/400

[58] Field of Search ..... 4/526, 527, 533, 534, 4/600; 34/202; 128/365-368, 400; 219/366, 367, 369, 373, 400

[56] References Cited

U.S. PATENT DOCUMENTS

| | | | |
|---|---|---|---|
| 3,115,645 | 12/1963 | Spence | 4/534 |
| 3,128,161 | 4/1964 | Hudon | 219/373 |
| 3,419,915 | 1/1969 | Clark, Jr. | 4/526 |
| 4,370,543 | 1/1983 | Nemeth | 4/526 |
| 4,747,408 | 5/1988 | Chih | 128/400 |

FOREIGN PATENT DOCUMENTS

| | | | |
|---|---|---|---|
| 976332 | 5/1951 | France | 4/600 |

*Primary Examiner*—A. D. Pellinen
*Assistant Examiner*—Jeffrey A. Gaffin
*Attorney, Agent, or Firm*—Gregory M. Friedlander

[57] ABSTRACT

A hot air dryer suspended from the ceiling which may be raised or lowered from the ceiling to surround the user a blow dryer with a drying current of warm air utilizing a flexible skirt which forms a cylinder surrounding the user when lowered, the skirt having interior chambers with one or more interior slots allowing air to escape into the interior of the cylinder.

16 Claims, 2 Drawing Sheets

BODY AIR DRYER

BACKGROUND OF INVENTION

1. Field of Invention

The present invention relates to air dryers.

More particularly the invention relates to air dryers which dry the entire body of the user.

2. Prior Art

Elderly people and some who are handicapped have some difficulty with personal hygiene due to their inability to bend and lack of balance which is a regrettably common problem associated with old age or other infirmity. Handled sponges have long been used to allow these people to wash places which are otherwise unreachable. These and similar advances have helped make showers more comfortable as well as allowing the user to clean themselves more independently, but they do not generally make drying after the shower easier.

The primary purpose of this invention is to provide infirm people with a greater degree of independence in the shower and thereby giving them a greater amount of privacy. It may also be used in public areas where towels are in use to substitute for towels.

One of the more common appliances in public showers and rest rooms are hand dryers which utilize warm air to many beneficial purposes.

The present invention allows the user to use warm air to dry his entire body by directing warm, circulating air to the entire body of the user.

The prinicple object of the invention is to provide a chamber for directing warm air to a person to allow for easy drying.

Another object is to provide a method of drying which does not require bending.

Another object of the invention is to provide a drying means which may be used directly in the shower or not and which does not interfere with the utilization of space when the dryer is not in use.

Another object of the invention is to provide a full body drier which is inexpensive and is easy to install or take down in any existing room.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be had to the following detailed description taken in conjunction with the accompanying drawings in which like parts are given like reference numerals and wherein.

DETAILED DESCRIPTION OF THE PREFERRED EXEMPLARY EMBODIMENT(S)

Figure 1:
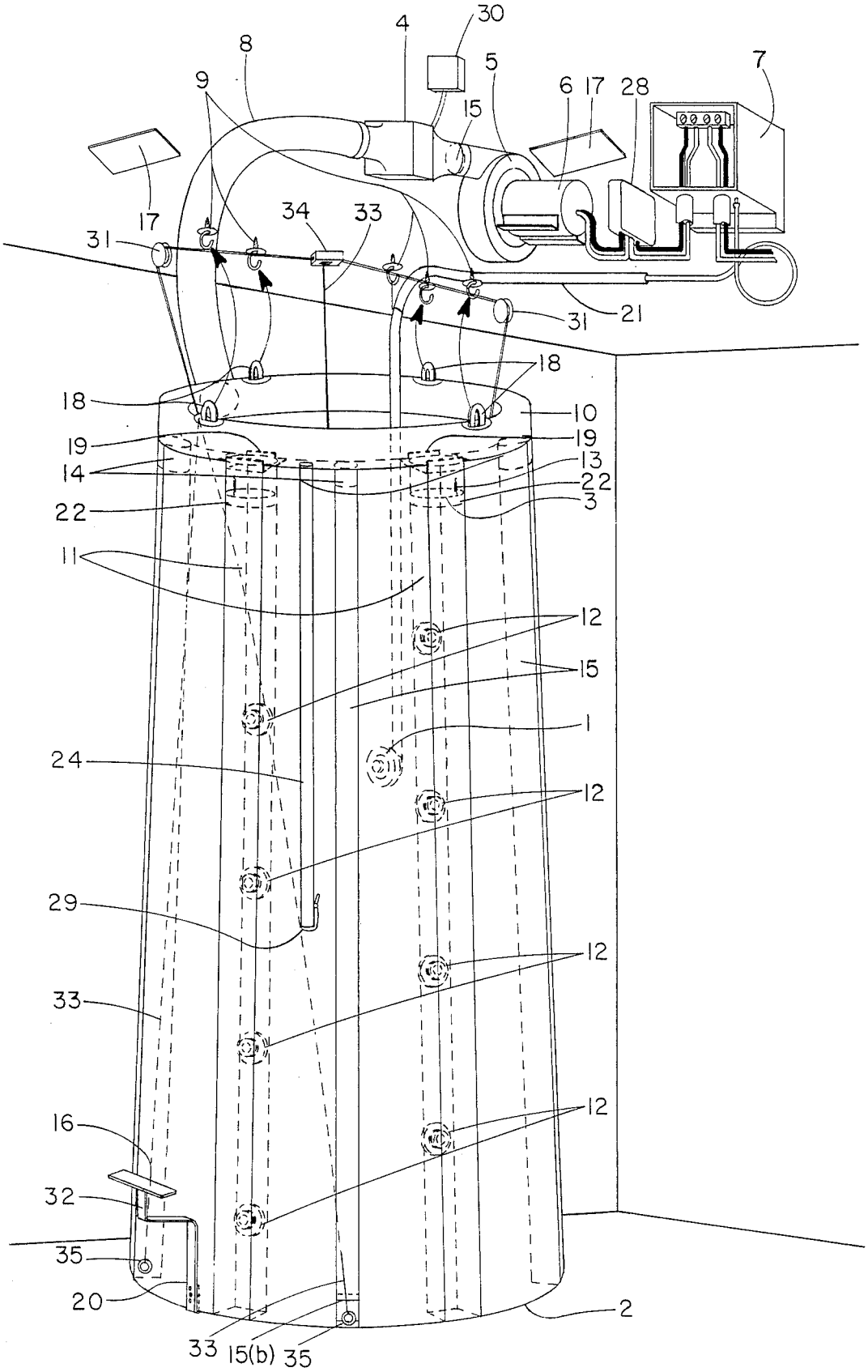
FIG. 1 is a perspective view of the invention when the skirt is in the lowered position.

As can best be seen by reference to FIG. 1 the preferred embodiment is cylindrical in shape and forms a complete enclosure. Although this design is the preferred embodiment, the same beneficial effects can be found in a semicircular or flat design.

The Body Air Dryer 1 is hung from the ceiling by hooks 9 which may be run to adjustable lines shown as arrows in FIG. 1 which in turn run to eyelets 18 which in turn are affixed onto header 10. Skirt 2 is attached to header 10 as described in more detail below.

Skirt 2 is comprised of flexible or foldable material such as 10 mil clear plastic with an embedded scrim capable of withstanding temperatures from the hot air, which was usually less than 150 degrees fahrenheit, without distortion.

The skirt 2 in the preferred embodiment would have a diameter of approximately 3 feet and the height of approximately 7 feet and be cylindrical. The cylindrical shape is desired so that the user is not subjected to drafts from un-heated exterior air currents when the device is in use.

A fan 5 blows air through a heating element 4 having a heating capacity of 5,000 watts producing approximately 450–500 cubic feet per minute taking into consideration static pressure. The fan is powered by a one horse power motor 6. Fan or blower 5 is a squirrel cage type having a diameter of 10 inches and being turned at approximately 1700 revolutions per minute (RPM) to produce approximately 5000 cubic feet per minute (CFM) in the forward position and approximately 2600 CFM when run in reverse. The fan 5 is wired from the power from the house in switching box 7. An automatic reversing unit 28 controls the motor 6 of fan 5 to raise and lower the skirt 2 as set forth in more detail below.

Air is pushed by the fan 5 and through the heater 4 and moves thence through hose 8 which communicates with header 10 by way of a top cavity in the header at the juncture of hose 8 and header 10.

Header 10 and haoe 8 may be elastic and remain inflated by way of coils embedded in the plastic or other means when the device is in use and when the device is out of use. Headers 10 communicates with chambers 11 by way of valves 22 within one or more bottom cavities 19 formed in the header at the intersection of header 10 and valve 22.

Figure 3:
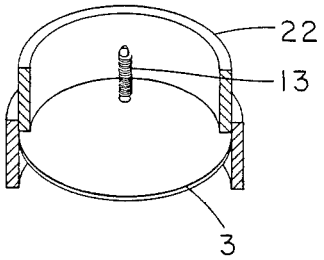
FIG. 3 shows a detailed view of a one way valve or diaphragm used to prevent air from escaping from nozzles when the device is retracting.

Valve 22 is shown in detail in FIG. 3 and is a self sealing one way valve 22. The air is prevented from moving back through valve 22 by diaphragm 3 which is held closed by way of spring 13. An alternate design would have diaphragm 3 be made sufficiently flexible and resilient so that it would bend with the flow of air forward but snap back into place if the air flow reversed in a manner known in the art of valves without the use of spring 13.

Figure 4:
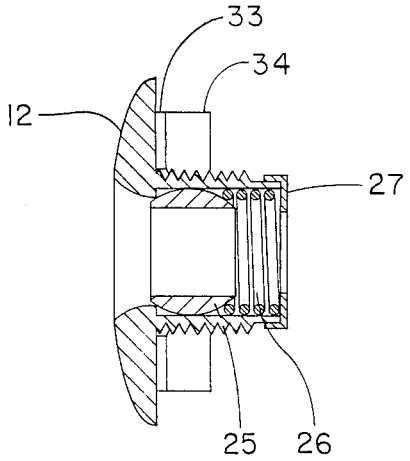
FIG. 4 shows a detailed view of a nozzle used to direct air.

Chamber 11 is equipped along its length with air dispensing nozzles 12. Air dispensing nozzles 12 are shown in more detail in FIG. 4. FIG. 4 shows the nozzles to comprise a ball 25 defining a cylindrical opening held loosely in place place within a cylinder by a spring 26. A fitting of lesser diameter than the ball is fixed at the top of the nozzle 12 to prevent the ball from being forced out of the nozzle 12. The spring is sealed in place by backing 27. This design is old in the art. These nozzles 12 allow the user to direct the flow of air in the desired direction. The nozzles 12 are separated from each other by approximately 1.5 feet. These nozzles 12 may be replaced by other types of nozzles 12 or may even be formed from the material of the skirt itself if adjustability is not essential.

A flexible hose 24 may be run from the header 10 down and may be equipped with an on/off valve 29. This valve 29 is of a type known in the art and is spring biased to the closed position. This hose would allow the user to dry otherwise difficult to reach places, but would shut off when not in use to help form a vacuum when the motor 5 is reversed.

The hose 24 communicates with the header end by way of a hose opening defined by the intersection of hose 24 and header 10.

Header 10 also communicates with air pockets 15 through cylinders 14 which fit between holes defined by the top of air pockets 15 and header 10. At the bottom of air pockets 15, the spring may be held by closures 15(*b*) which do not allow air to pass and effectively seal the end of pockets 15. The fan 6 is reversible and when reversed produces a vacuum and header 10 which effectively closes valves 22 and thereby transfers the vacuum to air pockets 15. As air pockets 15 are sealed at the bottom 15(*b*) this section draws up the entire skirt automatically. Skirt 2 is equipped with stand 32 which supports magnetic plate 16. The connection between stand 32 and plate 16 may be ball jointed to all for a more positive connection between the magnetic plate 16 and the magnet 17. When the installation is made, the magnetic plate 16 is aligned with a ceiling magnet 17. When the device is fully retracted, magnetic plate 16 is helf by ceiling magnet 17.

Since the vacuum may not always draw the skirt up properly due to possible malfunction in the skirt, the skirt is equipped with an eye hook 25 through which a line 33 runs over a pulley wheel 31 to a central block 34 from which the lines 33 drop straight down and these lines coming down from block 34 may be pulled by the user in order to assist the skirt 2 in it's upward movement.

It is envisioned that the use of the air pockets 15 will be eliminated by the use of the pulley 31 and block 34 arrangement using lines 33 in alternate embodiments, but the preferred embodiment envisions the use of the pulley arrangment as an optional feature with major function being to obtain maximum automation for infirm users.

Figure 2:
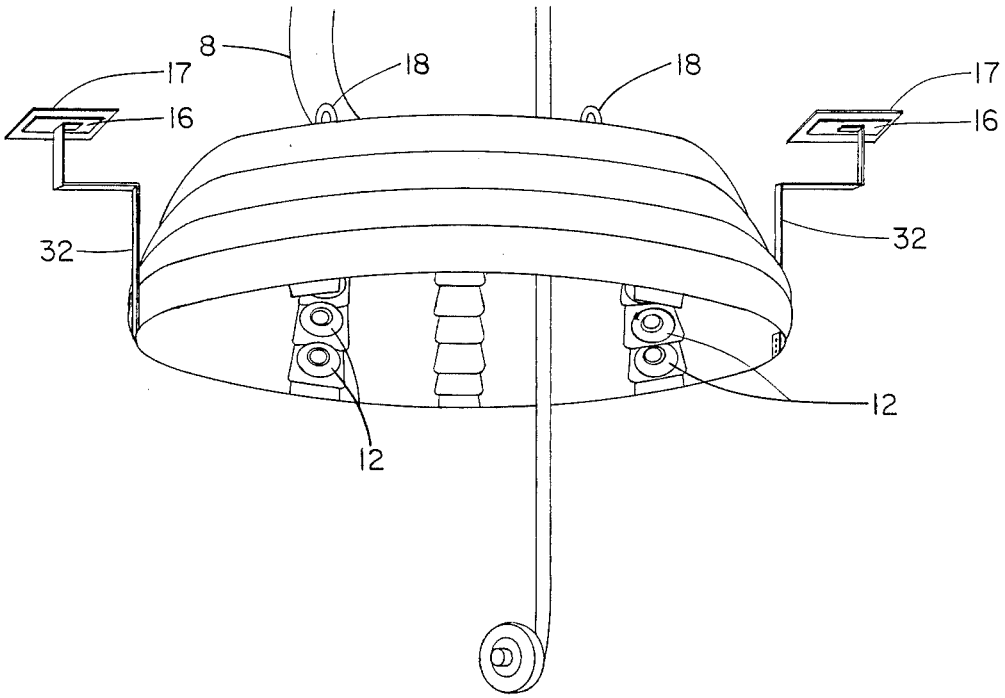
FIG. 2 is a perspective view of the invention shown in FIG. 1 when the skirt is raised.

Skirt 2 is equipped with stands 32 which support magnetic plates 16. The connection between stand 32 and plate 16 may be ball jointed to allow for a more positive connection between the magnetic plate 16 and the magnet 17. When the installation is made, the magnetic plate 16 is aligned with a ceiling magnet 17. When the device is fully retracted, magnetic plate 16 is held by ceiling magnet 17. Other techniques for holding the invention to the ceiling, for example through the use of velcro strips or by cleets in the pully system for raising the skirt, could be used within the scope of the invention with the only requirement being that the means for holding the invention in the raised position be released or releasable under the inflating pressure from the fan. FIG. 2 shows the use of the magnetic plates 16 and ceiling magnets 17 for holding the collapsed skirt to the ceiling.

The device comes as shown in FIG. 2 in the retracted position to minimize shipping bulk and to assist in placing magnets 17. The motor 6 and heater 4 are attached to the ceiling outside of the shower area to prevent electric shock and non-conducting hose 8 carries air to the header 10 and non-conducting, insulated tube 21 carries the waterproof operater thermostat control 1 to the interior of the skirt at a level the user can reach. This level of the waterproof operator thermostat control 1 may be adjustable by having the tube 21 be of adjustable length. The eyelets 18 and adjustable lines are used to attach the device level from the ceiling. Magnets 17 are then attached and the device is ready to use.

When the device is activated by turning on the switch 1, air blows through the heater which also comes on. The heater may be controlled by a thermostat on the water proof operator switch 1. As the air blows through valves 22, the diaphragm 3 is pushed open against the spring 13. The air fills chambers 11 and also spaces 15 pushing the skirt down. A pressure relief valve 30 may be added at any point along the air flow to prevent too much pressure from building within the skirt and header.

Air is pumped from reversible motor 5, through heater 4 into air feed line 8 into heater 10. Heater 4 automatically cuts off and switch 28 automatically runs the motor in reverse for a desired period of time after the device is turned off using waterproof operator thermostat control 1.

As the chambers 11 and spaces 15 fill with air, the device unfolds and stretches towards the floor. This serves to disengage the magnets 17. The user merely stands within the cavity created by the descending skirt 2.

In the preferred embodiment, there are four equally spaced chambers 11 and spaces 15. However, the same concept could be accomplished with only one chamber 11 and one space 15.

Similarly, the device need not be completely circular, but may have openings or slits extending the length of the skirt to facilitate entry or exit or to allow for supports to extend to the interior for support of the user. Because the device fully retracts when out of use, it may be installed within an existing shower and allows the user to use the device without exiting the shower.

The estimated drying time using the preferred embodiment would be approximately 90 seconds. This would vary with the temperature of the air, the temperature which may be controlled by the user is between 30 degrees and 120 degrees fahrenheit.

When the device is switched off by the user, after drying or after automatically switching off by a timer in the switch 28, switch 28 reverses the motors. Since no air backs through the hose 24 or the nozzles 12, a vacuum is formed within spaces 15. This vacuum, assisted with pull strings 37 is necessary, retracts the now dry skirt 2 back into place at the ceiling.

Several designs are consistent with the coiling or uncoiling action. The material may simply form bellows as it goes up or may have accordion type folds to assist the retraction.

Because many varying and different embodiments may be made within the scope of the inventive concept herein taught and because many modifications may be made in the embodiment(s) herein detailed in accordance with the descriptive requirements of the law and it should to be understood that the details herein are to be interpreted as illustrative and not in a limiting sense.

What is claimed is:

1. A drying apparatus receiving hot air from a fan and heating element suspended from a ceiling comprising:

(a) a mooring means suspended from the ceiling;

(b) a header with a top cavity for receiving the exhaust of the fan suspended from the mooring means and defining at least one bottom cavity;

(c) a flexible skirt having a top and a bottom, defining at least one flexible chamber which chamber defines a top opening and at least one side opening which skirt is suspended from the header and having the chamber top opening fitting over and around the bottom cavity;

(d) a nozzle fitting over the side opening and directing the flow of air therefrom;

2. A drying apparatus receiving hot air from a fan and heating element suspended from a ceiling comprising:

(a) a mooring means suspended from the ceiling;

(b) a header with a top cavity for receiving the exhaust of the fan suspended from the mooring means and define at least one bottom cavity;

(c) a skirt having a top and a bottom, defining at least one chamber which chamber defines a top opening and at least one side opening which skirt is suspended from the header and having the chamber top opening fitting over and around the bottom cavity;

(d) a nozzle fitting over the side opening and directing the flow of air therefrom;

(e) a means for raising and lowering the skirt.

3. The apparatus of claim 2 wherein the means for raising and lowering the skirt bottom comprises:

(a) a line connected to the bottom of the skirt;

(b) a pulley attached to the ceiling;

(c) and wherein the said line runs through the pulley and downward so that by pulling on the line the skirt is raised.

4. The apparatus of claim 2 further comprising:

(a) a means for regulating the flow of air from the fan to the discharge of the nozzle.

5. The apparatus of claim 4 wherein the means for regulating further comprises a one-way valve inserted between the chamber and the header within the bottom cavity.

6. The apparatus of claim 5 further comprising:

(a) a hole defined by the header, (b) an air pocket defining a top opening connected to the skirt along the length of the skirt, the circumference of the top opening being in contact the header around the hole defined by the header.

(c) a reversing switch for the fan.

7. The apparatus of claim 2 further comprising a holding means for keeping the skirt in the raised position after it is lifted using the means for raising and lowering;

8. The apparatus of claim 8 wherein the holding means further comprises;

(a) magnetic plates attached to the ceiling;

(b) a stand connected to the bottom of the skirt;

(c) a magnetically attachable plate attached to the top of said stand so that when the skirt is fully raised the metallically attachable plate contacts the magnetic plate to hold the skirt in the raised position.

9. The apparatus of claim 2 wherein the invention further comprises:

(a) a hose opening wherein the header further defines a hose opening;

(b) a hose connected to the header and enclosing the hose opening;

(c) an on/off valve fitted along then lenth of the hose.

10. The apparatus of claim 2 wherein the skirt forms an enclosure having an interior and an exterior and where in the nozzles open into the interior.

11. The apparatus of claim 10 wherein there are four equally spaced chambers each having 4 equally spaced side openings equipped with a nozzel.

12. The apparatus of claim 10 wherein the diameter of the enclosure formed by the skirt is greater than two feet and less than four feet.

13. The apparatus of claim 2 wherein the temperature of the heating element is controlled by an adjustable thermostat.

14. A drying apparatus receiving hot air from a fan and heating element suspended from a ceiling comprising:

(a) a mooring means suspended from the ceiling;

(b) a found header with a top cavity for receiving the exhaust of the fan suspended from the mooring means and defining at least one bottom cavity;

(c) a cylindrical collapsable skirt having a top and a bottom, defining at least one chamber which chamber defines a top opening and at least one side opening which skirt is suspended from the header and having the chamber top opening fitting over and around the bottom cavity.

(d) a nozzle fitting over the side opening and directing the flow of air therefrom;

(e) a means for raising and lowering the skirt towards the ceiling.

(f) a means for holding the skirt in the raised position.

15. The apparatus of claim 14 wherein there are four equally spaced chambers each having 4 equally spaced side openings equipped with a nozzel.

16. The apparatus of claim 14 further comprising:

(a) a water proof operator switch having a thermostat attached to the fan and heating element running within the cylinder formed by the skirt.

* * * * *